United States Patent [19]

Stange

[11] 3,942,785

[45] Mar. 9, 1976

[54] SELF-ACTUATING SHEET INVERTER REVERSER

[75] Inventor: Klaus K. Stange, Pittsford, N.Y.

[73] Assignee: Xerox Corporation, Stamford, Conn.

[22] Filed: Nov. 25, 1974

[21] Appl. No.: 527,109

[52] U.S. Cl. ..... 271/65; 271/184; 271/274; 271/DIG. 9

[51] Int. Cl.[2] ..... B65H 29/60

[58] Field of Search ..... 271/65, 184, 185, 186, 271/225, DIG. 9, 274, 273, 272

[56] References Cited

UNITED STATES PATENTS 3,856,295 12/1974 Looney ..... 271/65

FOREIGN PATENTS OR APPLICATIONS 1,185,994 1/1965 Germany ..... 271/65

*Primary Examiner*—Evon C. Blunk
*Assistant Examiner*—Bruce H. Stoner, Jr.

[57] ABSTRACT

A reproduction machine adapted for producing copies of an original on either or both sides of a copy sheet and forwarding the finished copy to a collator. To collate the produced copy in the proper orientation, an inverter-reverser is employed to allow single-sided copy to pass directly to the collator, route single-sided copy to a secondary feed tray for subsequent processing to allow copying on the reverse side of the sheet to produce duplex copies; and for inverting duplex copies prior to delivery to the collator to provide the required sheet orientation in the collator.

1 Claim, 5 Drawing Figures

SELF-ACTUATING SHEET INVERTER REVERSER

BACKGROUND OF THE INVENTION

In recent years a number of high volume electrostatic copy machines have been introduced. In order to take advantage of the high speed copying capabilities of these machines, document handlers adapted to feed the documents to be copied to the platen of the copy machine and remove them therefrom have been utilized to reduce the time required for an operator to place and remove documents. Further, to cope with the large quantities of copies produced, collators of the type illustrated in U.S. Pat. No. 3,830,590, commonly assigned with the instant application, have been introduced for collating the copies to minimize operator involvement with the copying process. Following these developments, the need for a reproduction machine which would reproduce on both sides of a sheet of paper, ordinarily referred to as duplex copying was recognized. This presents a number of problems in a copy reproduction system adapted to produce both single-sided copy and duplex copy in that the machine must be capable of routing single-sided copy sheets directly to the collator, must be adapted for returning single-sided copy sheets to a paper supply tray in preparation for copying on the opposite side of the sheet to produce duplex copies, and must be adapted to invert the duplex copy to provide the proper orientation thereof prior to passage to the collator if the correct page order is to be maintained so that the finished copies are ready for stapling or binding without operator involvement. Sheet inverter-reversors also find utility in document handlers for turning over documents after imaging of the first side for imaging or exposing the reverse side. Further, certain automatic document handlers may require inversion and reversal of a document when operated in an automatic recirculation mode for repetitive imaging of the document. Sheet feed inverting mechanisms of the type illustrated in U.S. Pat. No. 3,523,678 and U.S. application Ser. No. 429,252 now U.S. Pat. No. 3,856,295 commonly assigned with the instant application, may be employed for this purpose. However, most known inverters are capable of handling sheet material within a fairly narrow size range and paper weight.

At the high speeds encountered, an inverter-reverser must be provided that will positively handle light weight paper without damaging the leading or trailing edges of the paper. For heavy weight paper, the device must be capable of coping with the high inertial forces necessary for inverting the sheets at high speed. Further, since a wide variety of paper stock may be encountered, it is desirable to provide a device which is sheet size insensitive, that is, one which will handle a variety of sheet sizes without the necessity for specialized operator adjustment thereto or extensive sensing devices to sense the size of the sheets being fed to the inverter.

It is therefore an object of this invention to provide a mechanism adapted to deliver single-sided copy sheets to the collator, or if duplex copies are required, to route the single-sided copy to a duplexing paper tray and after the duplex copy is produced, route the duplex copy sheet through a self-actuating inverter to the collator to provide the proper sheet orientation in the collator.

SUMMARY OF THE INVENTION

This invention relates to a self-actuating inverter including first and second rolls forming a first roll pair to receive copy sheets transported to the inverter, the first roll being driven in a sheet forwarding direction, the second roll being freely rotatable for co-action therewith. A second roll pair formed by the first roll and a third idler roll is adapted to feed the sheet in a reverse direction. A third roll pair downstream from the first and second roll pairs is provided with an idler roll and a cooperating driven roll adapted to feed the sheet in the same direction as the second roll pair, one of the rolls of the third roll pair being mounted on lever means pivotally associated with the first roll pair, movement of a sheet between the first roll pair causing the first roll pair to move apart a distance equal to the thickness of the sheet and pivot the lever means to separate the rolls of the third roll pair a distance greater than the thickness of the sheet to prevent pinching the sheet therebetween, movement of the trailing edge of the sheet from between the rolls of the first roll pair allowing the rolls of the third roll pair to move together into contact with the sheet therebetween and thereby drive the sheet into the rolls of the second roll pair to feed the sheet in the reverse direction.

DESCRIPTION OF THE PREFERRED EMBODIMENT

Figure 1:
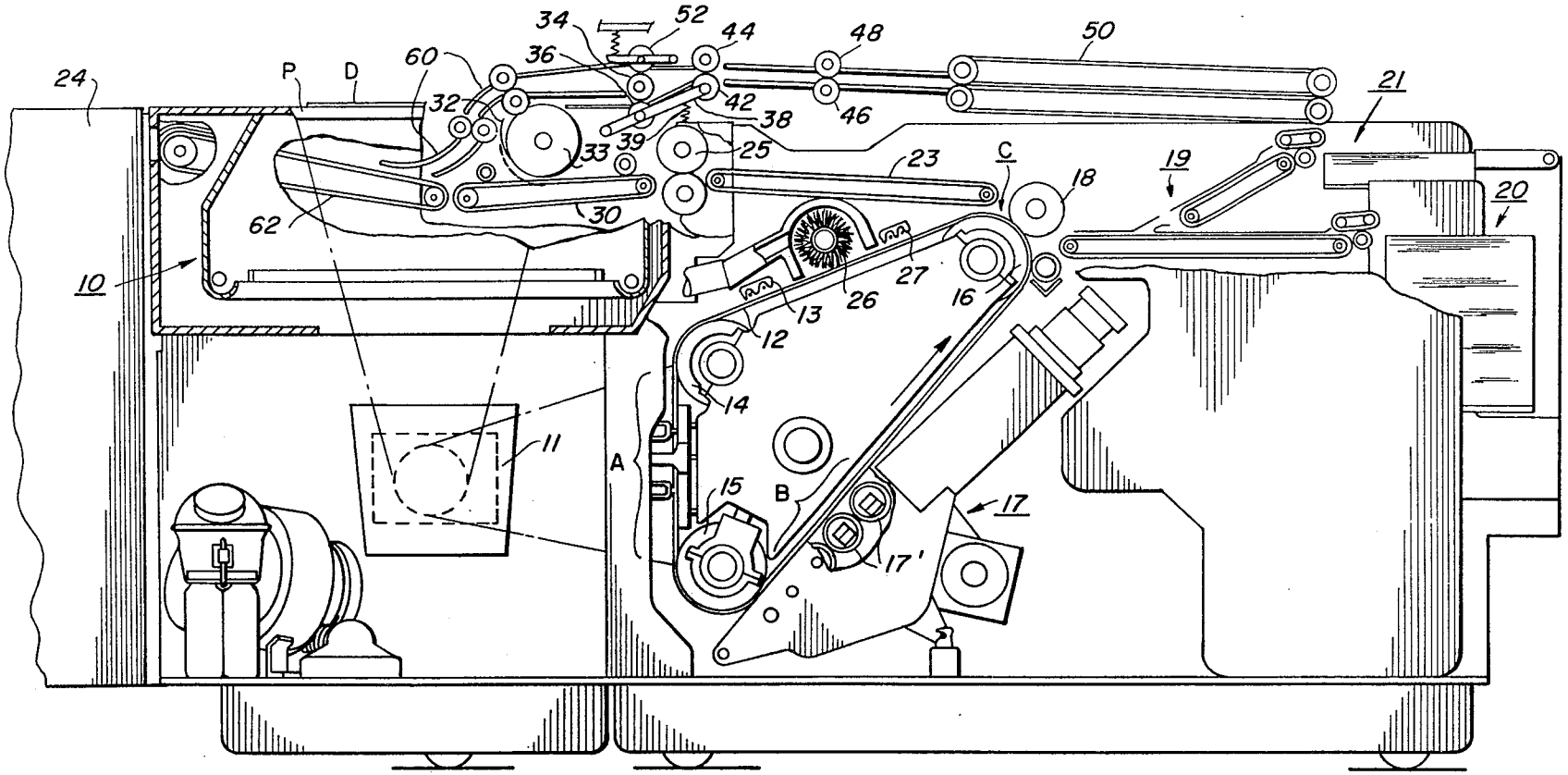
FIG. 1 is a schematic representation of an electrostatic reproduction system including a reproduction machine and a collator.

For a general understanding of an electrostatic processing system in which the invention may be incorporated, reference is had to FIG. 1. In the illustrated machine, an original D to be copied is placed upon a transparent support platen P fixedly arranged in an illumination assembly generally indicated by the reference numeral 10. While upon the platen, an illumination system flashes light rays upon the original thereby producing image rays corresponding to the information areas on the original. The image rays are projected by means of an optical system 11 to an exposure station A for exposing the photosensitive surface of a moving xerographic plate in the form of a flexible photoconductive belt 12. In moving in the direction indicated by the arrow, prior to reaching exposure station A, that portion of the belt being exposed would have been uniformly charged by a corona device 13 located at the belt run extending between belt supporting rollers 14 and 16. The exposure station extends between the roller 14 and a third support roller 15.

The exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes around the roller 15 and through a developing station B located at a third run of the belt wherein there is provided a developing apparatus generally indicated by the reference numeral 17. The developing apparatus 17 comprises a plurality of brushes 17' which carry developing material to the adjacent surface of the upwardly moving inclined photoconductive belt 12 in order to provide development of the electrostatic image.

The developed electrostatic image is transported by the belt 12 to a transfer station C located at a point of tangency on the belt as it moves around the roller 16 whereat a sheet of copy paper is moved at a speed in synchronism with the moving belt in order to accomplish transfer of the developed image. There is provided at this station a transfer roller 18 which is arranged on the frame of the machine for contacting the non-transfer side of each sheet of copy paper as the same is brought into transfer engagement with the belt 12. The roller 18 is electrically biased with sufficient voltage so that a developed image on the belt 12 may be electrostatically transferred to the adjacent side of a sheet of paper as the same is brought into contact therewith. There is also provided a suitable sheet transport mechanism 19 adapted to transport sheets of paper seriatim from a first paper handling mechanism 20 or a second paper handling mechanism 21 to the developed image on the belt as the same is carried around the roller 16. A programming device operatively connected to the mechanisms 20, 21 and the illumination device for producing an electrostatic latent image on the belt 12, is effective to present a developed image at the transfer station C in time sequence with the arrival of a sheet of paper.

The sheet is stripped from the belt 12 after transfer of the image thereto by a stripper transport 23 and thereafter conveyed by the stripper transport into a fuser assembly generally indicated by the reference numeral 25 wherein the developed and transferred xerographic powder image on the sheet is permanently affixed thereto. After fusing, the copy is either discharged from the reproduction machine into the collator 24 or routed back to paper handling mechanism 21 in a manner to be hereinafter described. The toner particles remaining as residue on the developed image, background particles, and those particles otherwise not transferred are carried by the belt 12 to a cleaning apparatus positioned on the run of the belt between rollers 14 and 16 adjacent the charging device 13. The cleaning device, comprising a rotating brush 26 and a corona emission device 27 for neutralizing charges remaining on the particles, is connected to a vacuum source (not shown) for removing the neutralized toner particles from the belt prior to the formation of subsequent images thereon.

Figure 2:
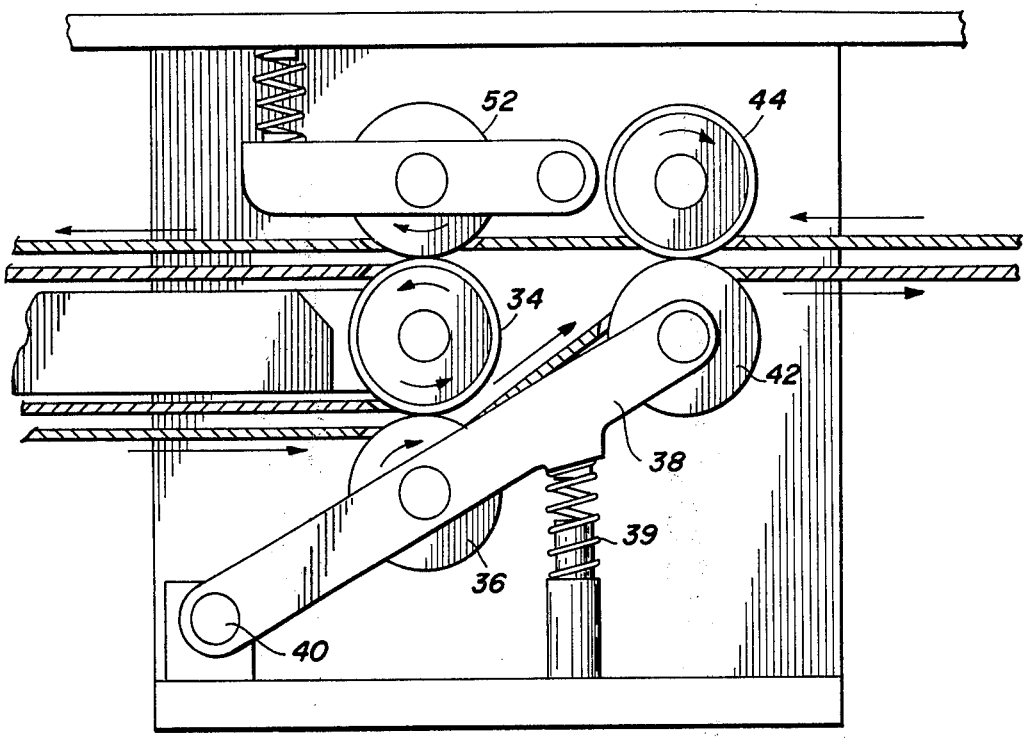
FIG. 2 is an enlarged view of the inverter-reverser portion of the reproduction system illustrated in FIG. 1.

Referring now to FIGS. 1 and 2, there is illustrated an inverter-reverser mechanism adapted to receive copy sheets from the fuser 25 and route the fused copies either to the paper handling mechanism 21 or the collator 24.

The inverter-reverser mechanism includes a first transport 30 adapted to receive fused copies from the fuser for transport to the collator. When the reproduction system is being utilized to produce one-sided copy, the sheets from the fuser are transported by transport 30 directly to the collator 24 as illustrated in FIG. 1. When double-sided or duplex copies are to be produced, copies on the transport 30 are intercepted by a deflector 32 which is adapted for movement into the sheet path as illustrated in dotted line position to direct the sheets through a return path to paper handling mechanism 21 in a manner to hereinafter explained. With the deflector 32 in the intercept position, the sheets are fed into the nip of a first roll pair formed by a drive roll 34 and an idler roll 36. Idler roll 36 is mounted on lever arm 38 which is pivotally anchored to the frame of the machine on a pivot pin 40. Lever arm 38 is biased toward roll 34 by a suitable means such as spring 39.

A third roll pair downstream from the first roll pair is formed by an idler roll 42 mounted on lever arm 38 and a driven roll 44 disposed opposite thereto. Roll 44 is adapted to be driven in a direction to move sheets to the paper handling mechanism 21. A fourth roll pair comprising idler roller 46 and a driven roller 48 are adapted to receive sheets from roll pair 34, 36 and feed the sheets to transport belts 50 for forwarding the sheets to mechanism 21. When the desired number of one-sided copies have been produced and delivered to the paper handling mechanism 21, the paper handling mechanism 20 may be inactivated and the paper handling mechanism 21 activated. It should be understood that in following the paper path around roller 34 and between feed roll pair 34, 36, the copy sheets are turned over, i.e., the printed material is on the top of the sheets in paper handling mechanism 21.

Upon re-energization of the machine, the sheets from paper handling mechanism 21 are fed through the reproduction machine for copying on the blank side of the sheet in the same manner as described heretofore. As the duplex copy is exited from the fuser it is carried by the transport 30 and deflected around roll 33 in the same manner as heretofore described and illustrated in FIG. 1.

Simultaneously with the activation of the machine for producing the duplex copy, roll 44 would be energized for continuous rotation in the direction illustrated by the arrow thereon. Further, roll 48 would be inactivated and moved out of contact with idler roll 46 to prevent interference with the lead edge of sheets passing therebetween.

With the machine operating to print on the second side of the sheets, entrance of a sheet between roll pair 34, 36 will cause roll 36 to be displaced a distance equal to the thickness of the sheet. Through the mechanical advantage obtained by lever arm 38, roll 42 will be displaced a distance from roll 44 greater then the thickness of the sheet passing between rolls 34, 36 and allow free movement of the leading edge of the sheet therebetween. Stated another way, since roll 42 is mounted on lever 38 at a greater distance from pivot 40 than roll 36, displacement of roll 36 caused by passage of a sheet between rolls 34, 36 will cause a greater displacement of roll 42 to prevent the lead edge of the sheet from being pinched therebetween. As the trailing edge of the sheet leaves roll pair 34, 36, roll 36 will be moved into contact with roll 34 thereby causing roll 42 to move towards roll 44 and pinch the sheet therebetween to drive the sheet toward a second roll pair formed by roll 34 and an idler roll 52 disposed opposite thereto.

It can be seen that the upper guide members between rolls 52, 44, and 48 are disposed in a relatively straight line offset from the path of sheet travel through rolls 34, 36. As the trailing edge of the paper leaves rolls 34, 36, the main body of the sheet will be disposed in the guide between roll pair 42, 44 and roll pair 46, 48. Due to the orientation of the guides, the beam strength of the paper will cause the trailing edge thereof to lift up toward the nip of roll pair 34, 52. Further, in the event there is a slight sag in the trailing edge of the paper, the contact of the trailing edge with rotating rolls 34, which are coated with a high friction material such as rubber, will also act to help lift the lead edge into the nip of roll pair 34, 52.

Figure 5:
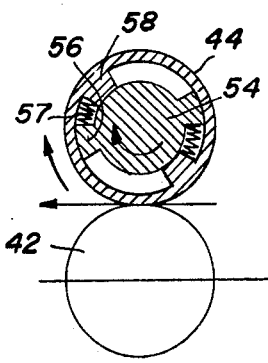
FIG. 5 is a schematic view of the time delay drive mechanism at the end of the delay period when the reversing roll pair is driving the sheet in the reverse direction.
Figure 3:
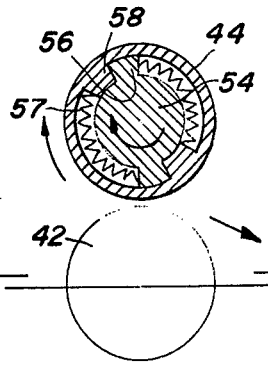
FIG. 3 is a schematic view of the time delay drive mechanism for the reversing roll utilized in the inverter-reverser of FIG. 2 when the reversing rolls are spaced apart.
Figure 4:
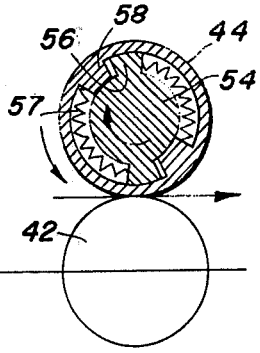
FIG. 4 is a schematic view of the time delay mechanism of FIG. 3 when the reversing rolls are first brought into contact with each other.

As stated heretofore, as the trail edge of the sheet leaves roll pair 34, 36, roll pair 42, 44 will pinch the paper to drive the paper toward the left as illustrated in the drawings. To provide a slight delay in the drive provided by roll 44 and prevent the sheet from being prematurely driven to the left before the trailing edge thereof has time to reach the nip between roll 34 and 52, the drive for roll 44 may have a time delay mechanism built therein. By reference to FIGS. 3, 4, and 5 there is illustrated a simple, trouble-free mechanism to provide this time delay. In the disclosed mechanism the drive shaft 54 for roll 44 is provided with drive lugs 56 solidly affixed thereto. The inner portion of roll 44 is provided with a plurality of wheel lugs 58 solidly affixed thereto adapted for cooperation with drive lugs 56. Suitable springs 57 are connected between shaft 54 and roll 44 to maintain the drive lugs in engagement with the wheel lugs as illustrated in FIG. 3 when roll pair 42, 44 are separated. When roll 42 is initially moved into contact with roll 44, the resistance to rotation generated by the inertia of idler roll 42 and the passage of a sheet in the direction opposite to the feed direction of roll 44 will cause the roll 44 to begin to rotate away from the drive lug against the force of the springs as illustrated in FIG. 4 into a final position illustrated in FIG. 5 and thereafter provide a solid drive in the reverse direction to feed the sheet to the left into the nip between roll 34 and 52. While coil springs 57 are illustrated, it should be understood that other biasing means such as torsion springs connected between roll 44 and shaft 54 could be utilized. The sheets exiting from roll pair 34, 52 are directed by guides 60 to the exit transport 62 of the processor for forwarding to collator 24.

In the illustrated embodiment, the collator of the type illustrated in U.S. Pat. No. 3,830,590 mentioned heretofore, is adapted to receive single-sided copies face down for collation purposes. Stated another way, single-sided copy entering the collator is deposited in the collator trays face down so that the informational material on page 1 is at the bottom followed by the informational area on the succeeding page etc. to provide collated booklets or reports having the proper page orientation. Thus, when employing the collator with duplex copies, page 1 must also be presented to the collator face down. Since the duplex copy exits from the fuser with page 2 down, the inverter inverts the copy to present the duplex copy to the collator with page 1 down. The subsequent sheets having pages 3 and 4 thereon would be presented to the collator with page 3 down etc. to provide correct numerical order of the sheets in the tray.

The disclosed reverser-inverter device is capable of extremely high speed operation since in the reversing roll 44 is constantly driven and does not need to be programmed on and off as each sheet appears thereat. Further, irrespective of the sheet dimension presented to the inverter the controlling factor is the exit of the trailing edge from roll pair 34, 36 which "actuates" roll pair 42, 44 for the reversing action. Thus, the inverter is capable of handling sheets of any length greater than the distance between roll pair 34, 36 and roll pair 42, 44 without changes in machine timing or other adjustments.

Further, since the inverter does not rely on a stop to physically contact the lead edge of the sheets prior to the reversing operation, the device is capable of extremely high speed operations without producing damage to the sheets.

While I have described a preferred embodiment of my invention, it is to be understood that the invention is not limited thereto but may be otherwise embodied within the scope of the following claims.

What is claimed is:

1. A self-actuating sheet inverter-reverser including first and second rolls forming a first roll pair to receive sheets transported to the inverter-reverser, said first roll being driven in a sheet forwarding direction, said second roll being freely rotatable for co-action therewith;

a second roll pair formed adjacent said first roll pair adapted to feed sheets in a reverse direction;

a third roll pair downstream from said first and second roll pair, said third roll pair comprising an idler roll and a cooperating driven roll adapted to feed sheets in the same direction as said second roll pair;

lever means adapted for pivotal movement about a predetermined pivot point, one of the rolls of said first roll pair and one of the rolls of the third roll pair being mounted on said lever means, the roll of said first roll pair being mounted between the roll of said third roll pair and said pivot on said lever, movement of a sheet between said first roll pair causing said first roll pair to move apart a distance equal to the thickness of the sheet passing therebetween and pivot said lever means to separate the rolls of said third roll pair a distance greater than the thickness of the sheet to prevent pinching the sheet therebetween, movement of the trailing edge of the sheet from between the rolls of said first roll pair allowing the rolls of said third roll pair to move together into contact with the sheet therebetween and drive the sheet into the rolls of the second roll pair to feed the sheet in the reverse direction;

a time delay drive mechanism adapted for drivingly connecting the drive shaft for the driven roll of said third roll pair and said driven roll, said time delay mechanism comprising a plurality of driving lugs affixed to the drive shaft of the driven roll of said third roll pair;

a plurality of driven lugs mounted on the driven roll of said third roll pair; and, biasing means adapted to bias said driven lugs away from said driving lugs in a direction opposite to the direction of rotation of the driven roll of said third roll pair, engagement of the rolls of said third roll pair causing said driving lugs to move toward said driven lugs in opposition to said biasing means, disengagement of the rolls of said third roll pair allowing said biasing means to move said driven lugs away from said driving lugs.

* * * * *